US009089888B2

(12) United States Patent
Patuzzi et al.

(10) Patent No.: US 9,089,888 B2
(45) Date of Patent: Jul. 28, 2015

(54) PRESS BRAKES

(75) Inventors: Luigi Patuzzi, Cologna Veneta (IT); Martti Vesa, Cologna Veneta (IT)

(73) Assignee: FINN-POWER ITALIA S.r.l., Cologna Veneta, VR (IT)

( * ) Notice: Subject to any disclaimer, the term of this patent is extended or adjusted under 35 U.S.C. 154(b) by 0 days.

(21) Appl. No.: 14/123,112

(22) PCT Filed: May 29, 2012

(86) PCT No.: PCT/IB2012/052678

§ 371 (c)(1),
(2), (4) Date: Jan. 30, 2014

(87) PCT Pub. No.: WO2012/164486

PCT Pub. Date: Dec. 6, 2012

(65) Prior Publication Data

US 2014/0165689 A1 Jun. 19, 2014

(30) Foreign Application Priority Data

May 30, 2011 (IT) ..... M12011A0977

(51) Int. Cl.
*B21D 5/02* (2006.01)

(52) U.S. Cl.
CPC ..... *B21D 5/0281* (2013.01); *B21D 5/02* (2013.01); *B21D 5/0272* (2013.01)

(58) Field of Classification Search
CPC ..... B21D 5/0272; B21D 5/02; B21D 5/0281
USPC ..... 72/389.3, 389.4, 389.5, 701
See application file for complete search history.

(56) References Cited

U.S. PATENT DOCUMENTS

| | | | | |
|---|---|---|---|---|
| 4,016,742 | A * | 4/1977 | Shiokawa | 72/389.5 |
| 4,640,113 | A | 2/1987 | Dieperink et al. | |
| 5,497,647 | A | 3/1996 | Nagakura | |
| 6,374,658 | B1 | 4/2002 | Gascoin et al. | |
| 8,438,894 | B2 * | 5/2013 | Hansen | 72/390.4 |
| 8,511,132 | B2 * | 8/2013 | Burgstaller et al. | 72/389.3 |

FOREIGN PATENT DOCUMENTS

| | | | |
|---|---|---|---|
| EP | 0384529 | A1 | 8/1990 |
| JP | 2000343125 | A | 12/2000 |
| JP | 2001121214 | A | 5/2001 |
| WO | 9846378 | A1 | 10/1998 |
| WO | 0143896 | A1 | 6/2001 |

* cited by examiner

*Primary Examiner* — David B Jones
(74) *Attorney, Agent, or Firm* — Robert E. Alderson, Jr.

(57) ABSTRACT

Press brakes capable of a high processing accuracy and short cycle times are provided.

12 Claims, 9 Drawing Sheets

PRESS BRAKES

CROSS-REFERENCE TO RELATED APPLICATIONS

This application is a National Phase Application of PCT International Application No. PCT/IB2012/052678, International Filing Date, May 29, 2012, claiming priority to Italian Patent Application No. MI2011A000977, filed May 30, 2011, each of which is hereby incorporated by reference in its entirety.

FIELD OF THE INVENTION

The present invention relates to a press brake, and in particular to a high performance press brake, preferably of the electromechanical type.

BACKGROUND OF THE INVENTION

For example, a known press brake of the electromechanical type is described in the document EP 0 384 529, where a pair of elongated working means cooperate together, and in which one of the two is stationary, while the other one is movable, approaching the first one. The movable working means, in conjunction with the supporting structure, is provided with a plurality of pulleys on which a strap passes, alternately on the pulleys of the supporting structure and on the pulleys of the mobile working means so as to exert an approaching action between the mobile working means and the stationary working means.

As it is known, in the press brake tool machines, supporting structures are provided for, which are designed to be particularly rigid, so as to limit the deformation thereof during the approaching action of the tool to the mould to deform a piece, for example a metallic one, interposed therebetween. The action between the tool and the mould can also reach several hundreds tons, inevitably leading to a deformation of the structure supporting the mould and of the structure handling the tool.

For example, from the document U.S. Pat. No. 6,374,658, it is known to implement a stationary lower panel comprising two slits that are opened on the side edges of the panel, and in which an abutment member is provided for in the proximity of the slot side opening in order to limit the panel deformation.

While being satisfactory under many points of view, however, this solution does not allow, during the press brake action, to compensate for the deformation of the lower panel so as not to sensibly deform the mould secured thereon, especially in the case where the movable upper panel exerts a thrust action, exerted not only laterally, but distributed along the extension of the tool connected thereon.

The document WO 98/46378 shows a structure of a press brake in which the transversal lower beam is stationary, and has a cut centrally that is horizontal and parallel to the mould housing hydraulic jacks, which lift, by deforming it upwardly, the upper part of the transversal lower beam.

While being satisfactory under many points of view, this solution turns out to be particularly complex and expensive to be implemented, forcing to a very elaborate control of the action of the jacks, which action deforms the mould support beam in the opposite direction relative to the stress imposed by the tool. It shall be apparent that the calibration of this device is particularly complex according to the type of processing also on the same piece, to the type of tool and mould that are used, and also as the working piece varies, forcing to continuous and complex maintenance and calibration operations.

A similar solution is shown in the document U.S. Pat. No. 4,640,113.

Another solution is known, for example, from the document U.S. Pat. No. 5,497,647, where the deformation is compensated by using tools that are provided in advance with an imposed deformation, contrary or opposite to the one that will be induced on the machine structure by the processing operations thereof.

Again, this solution, while being satisfactory under some points of view, is particularly complex to be used, forcing to use several machine components, and especially several tools according to the type of the piece and processing operation to be performed.

From what has been stated above, the need is particularly felt, not as much to reduce the deformation caused by the pressure of the tool on the piece, which, in turn, is discharged on the mould deforming the lower panel, but rather the need to control this deformation so that, while accepting the deformation of the lower panel, the dimensional geometric deformation of the mould is limited, allowing to ensure a planarity of the surfaces thereof, which thus maintain the ability to perform processing operations on the piece to be deformed with preset tolerances.

It is also felt the need to manage the press brake movements so as to avoid that the supporting structure is affected by the strong deformations, which from the mobile parts are discharged also on the supporting structure, thus deforming it and altering the measurements of the sensors connected thereupon, which measurements are useful to define the mutual position of the various machine components, such as, for example, the tool position relative to the mould, in fact decreasing the processing tolerances of the press brake machine.

These needs are among other things in sharp contrast with the further needs to have press brakes that are capable of higher and higher actions, and therefore capable to deform the pieces by applying higher and higher forces between the tool and the mould, and applying these forces in ever shorter times in order to reduce the processing cycle times.

The reduction of the processing cycle times forces to increase the handling speeds of the machine components, which increase, accompanied by the increase of the actions, in particular of the forces, between the tool and the mould, increase even more the deformation of the components and the press brake supporting structure, enhancing even more the need for a control of the deformations and the determination of machine management solution that are independent from the strong deformations of the supporting structures.

SUMMARY OF THE INVENTION

Therefore, it is the object of the present invention to provide a press brake, which has such structural and functional characteristics as to meet the above-mentioned needs, while obviating the drawbacks mentioned with reference to the prior art.

Such problems are solved by a press brake as described and claimed herein.

In accordance with a general embodiment, a press brake comprises a supporting structure. Said supporting structure comprises two flanks or shoulders located at the sides of the press brake. Said two flanks are connected together superiorly by at least one upper crossbeam. Said two flanks are connected together inferiorly by a beam or apron or lower bench, secured to the flanks in a non-movable manner.

Said lower bench has a plate-shaped body having a front surface, a rear surface opposite the front surface, and an edge. Said edge comprises an upper edge portion suitable to be at least partially connected to a mould.

Said press brake further comprises a movable rammer or beam movably connected relative to the press brake supporting structure for a movement thereof along a direction transversal to the longitudinal extension thereof, to approach said lower bench. Said rammer supports a tool suitable to cooperate with said mould to work a piece interposed therebetween.

Advantageously, said lower bench has a first slot cutting the bench body, thus forming a first window. Said first window opens on the edge of said bench forming a first portion of the bench body, which, when the bench is stressed by the action of the rammer, deforms differently from a contiguous portion of the bench body.

In accordance with a particularly advantageous embodiment, said lower bench has a second slot cutting the bench body forming a second window that is distinct from the first one. Said second window has a window edge which is closed so as to avoid that the second window opens on an edge of said bench.

In accordance with an embodiment, said second window extends substantially along an inclined direction relative to the bench upper edge, and partially overlaps said first window in a direction transversal to said bench upper edge.

Said second window forms a third portion of the bench body that, when the bench is stressed by the action of the rammer, deforms differently from the contiguous portions of the bench body so as to ensure a substantial planarity of the upper edge of the bench, and therefore of the mould.

Advantageously, the provision of a first window opening on the bench edge and a second window inclined relative to the bench upper edge and partially overlapping the first window ensures the possibility to optimize the bench deformation also when it is stressed in the heaviest manner, not as much to reduce the deformation, but rather to precisely control it, in order to control the planarity of the bench upper edge, and thus allowing a dimensional tolerance along the mould by a preset and reduced amount during the entire processing.

Further characteristics and advantages of the press brake according to the present invention will be apparent from the non-limiting detailed description set forth below with reference to the annexed figures.

DETAILED DESCRIPTION

Figure 1:
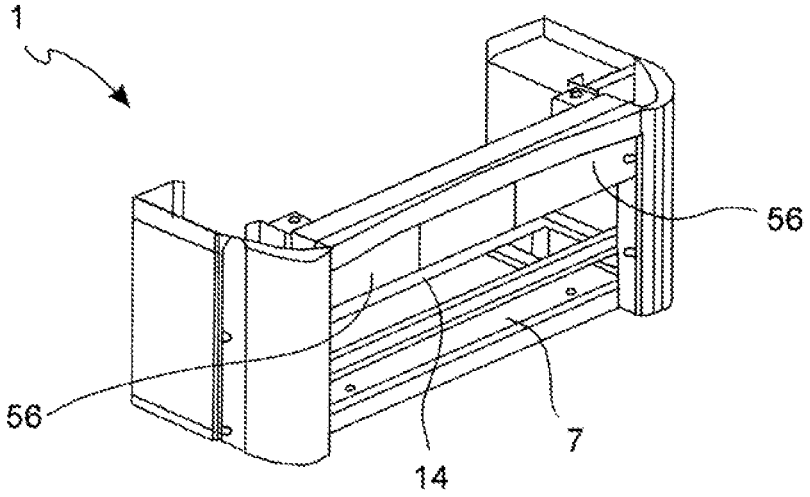
FIG. 1 shows schematically and in axonometric view a press brake.
Figure 2:
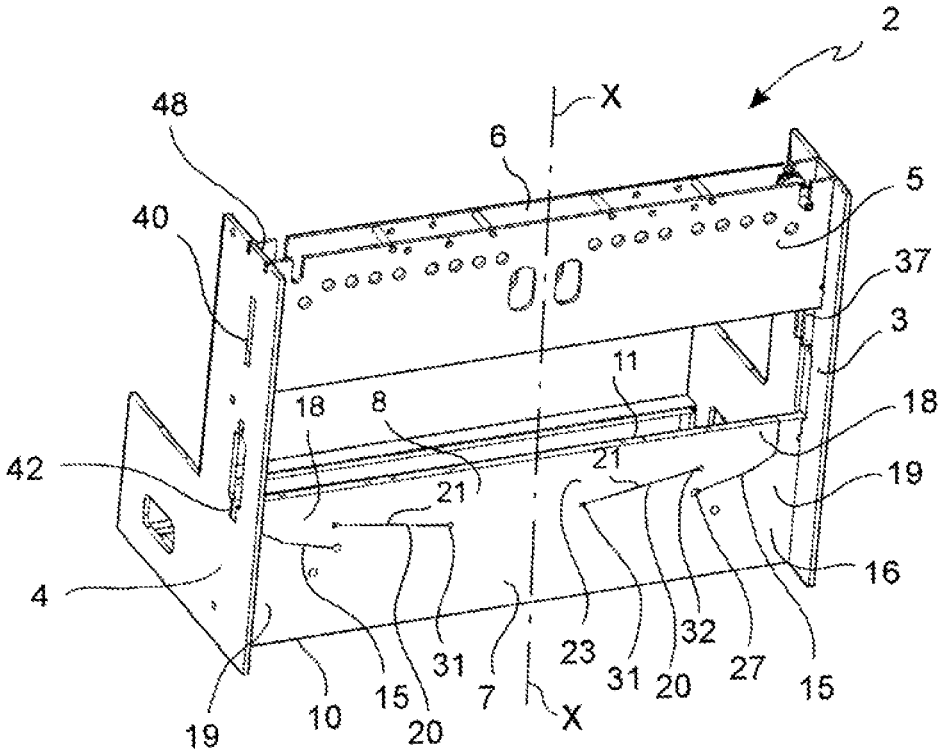
FIG. 2 shows in axonometric view from the left and front view a supporting structure of a press brake according to an embodiment.
Figure 3:
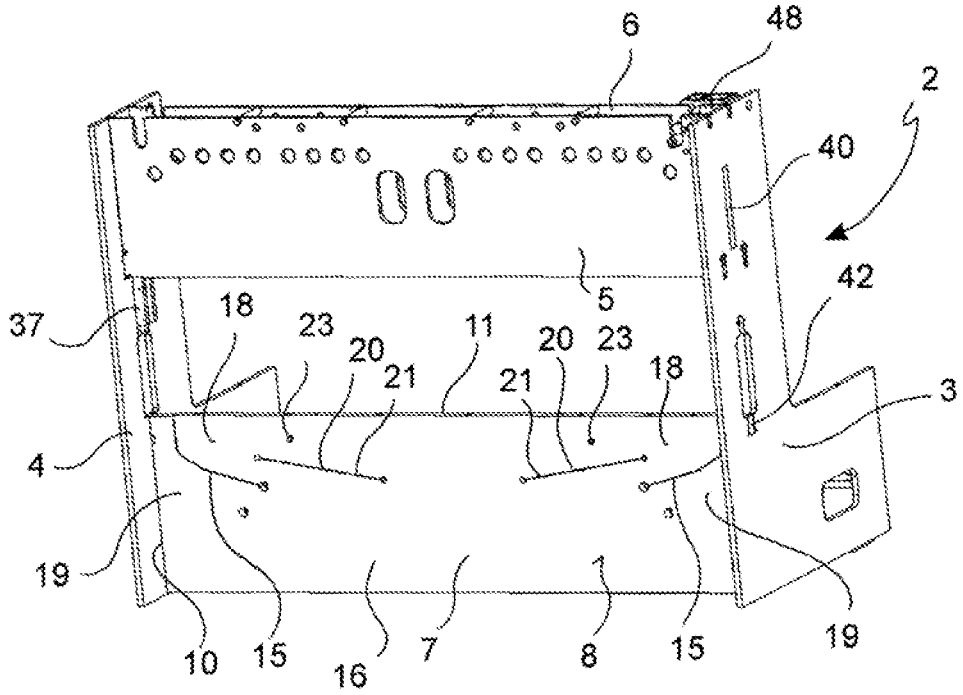
FIG. 3 shows in axonometric view from the right and front view the supporting structure of FIG. 2.
Figure 4:
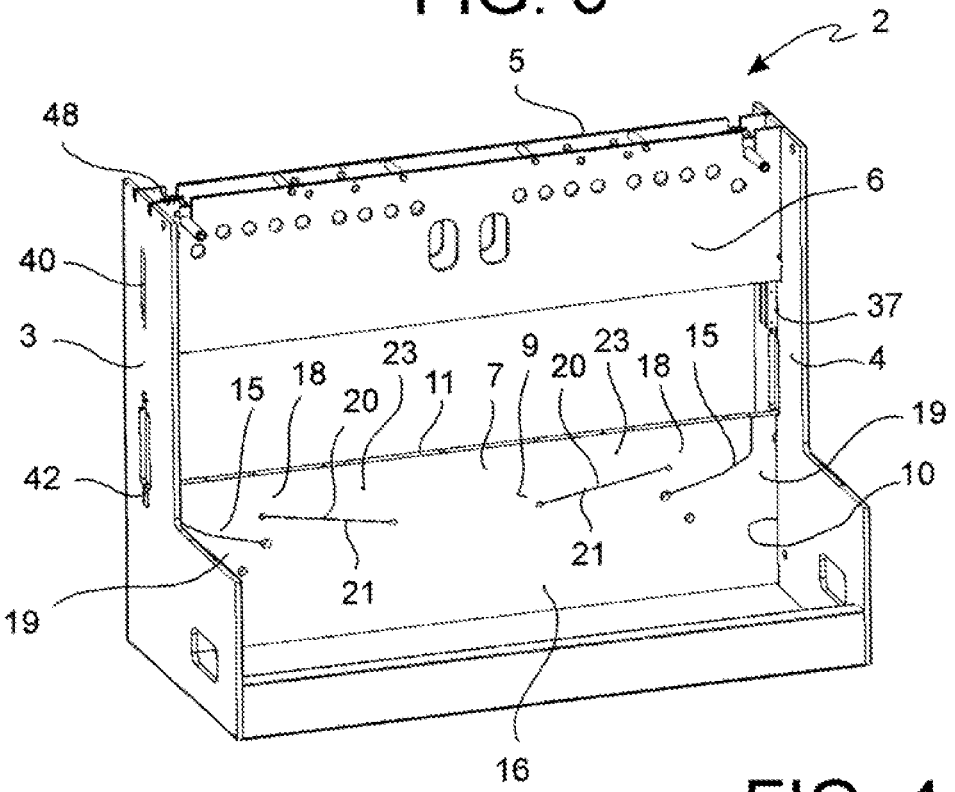
FIG. 4 shows in axonometric view from the right and rear view the supporting structure of FIG. 2.
Figure 5:
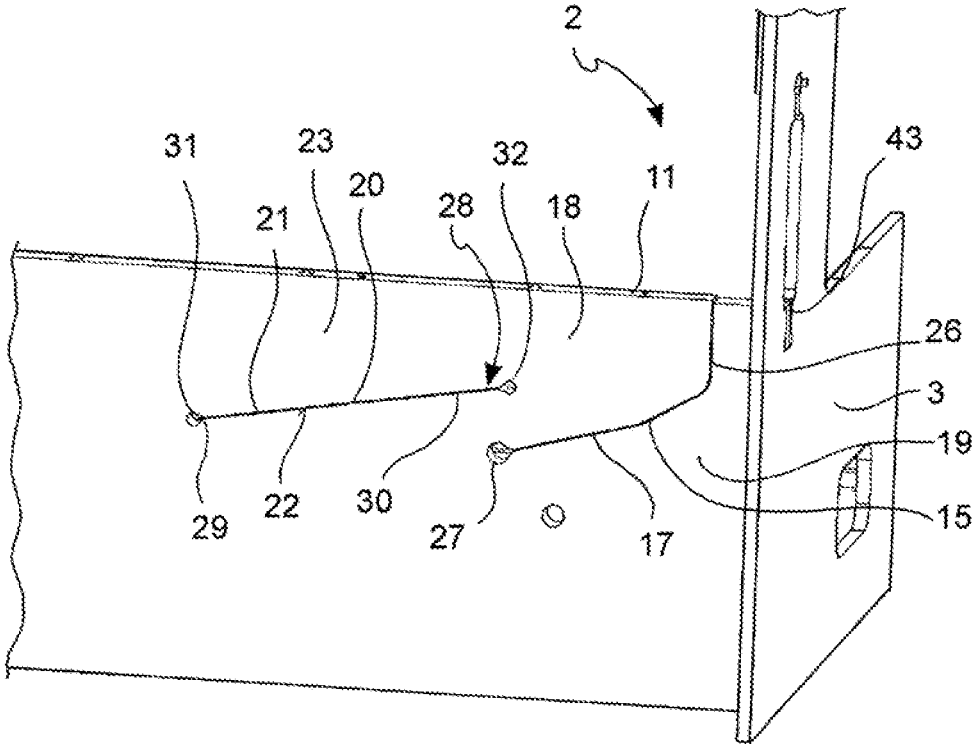
FIG. 5 illustrates in axonometric view a detail of the structure of FIG. 2.
Figure 6:
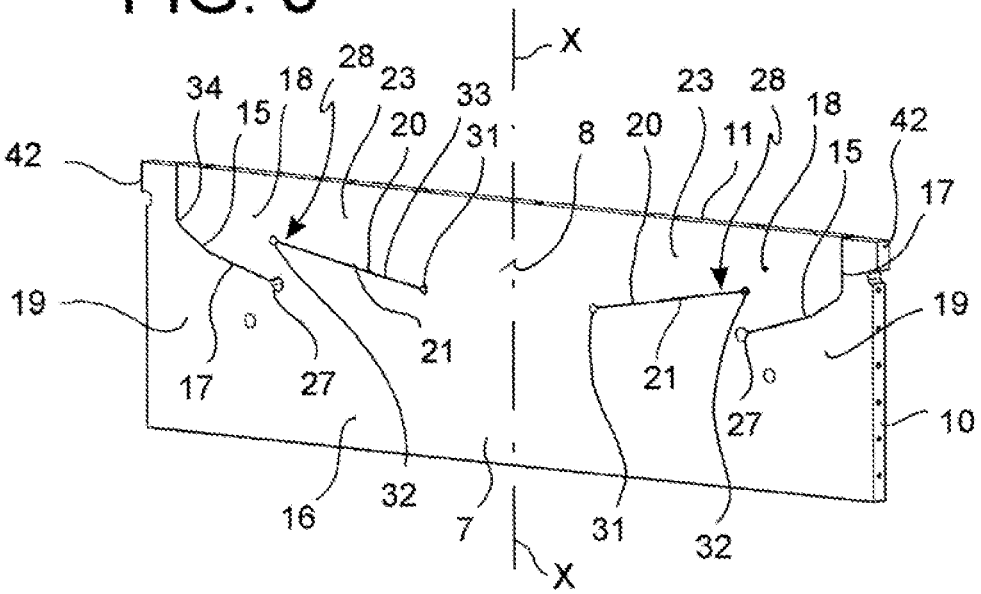
FIG. 6 illustrates in axonometric view a bench of a press brake according to a first embodiment.
Figure 7:
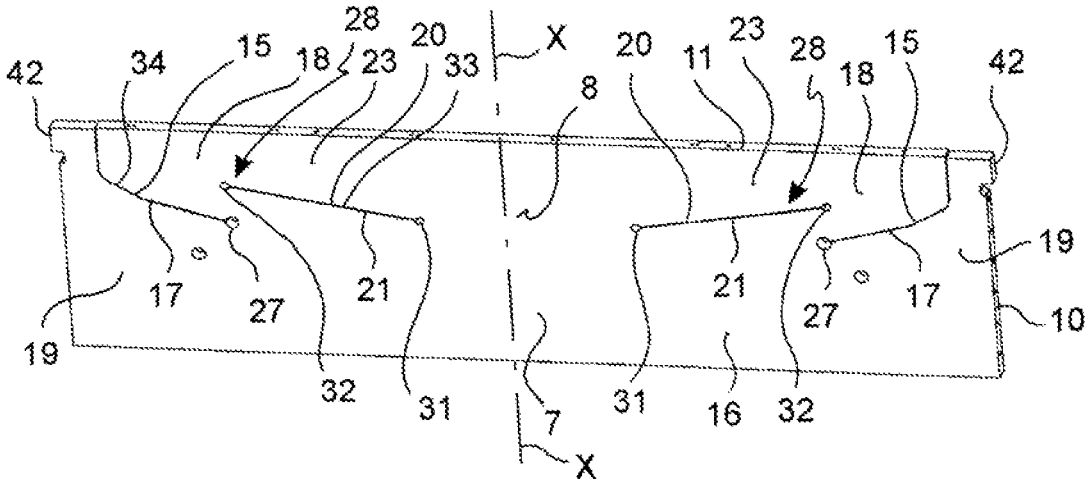
FIG. 7 illustrates in axonometric view a bench of a press brake according to a second embodiment.
Figure 8:
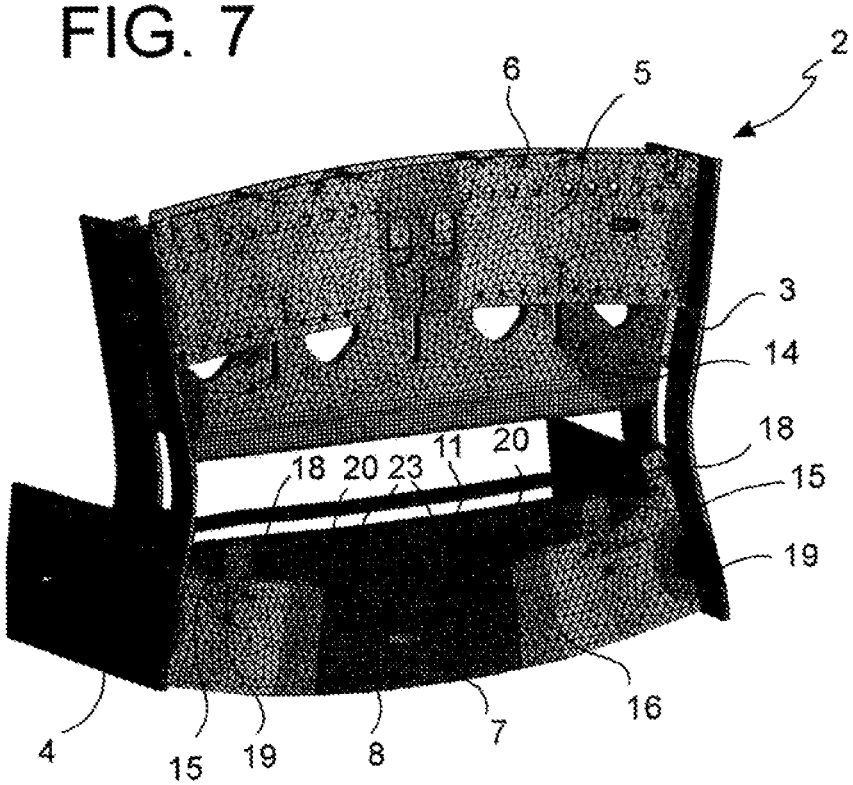
FIG. 8 illustrates in axonometric view a supporting structure of a press brake analyzed with finished elements, when it is subjected to the action of processing deformations of a rammer pressed at the highest force against the bench, in which the deformations are deliberately amplified and indicated with grey shades to better highlight them.
Figure 9:
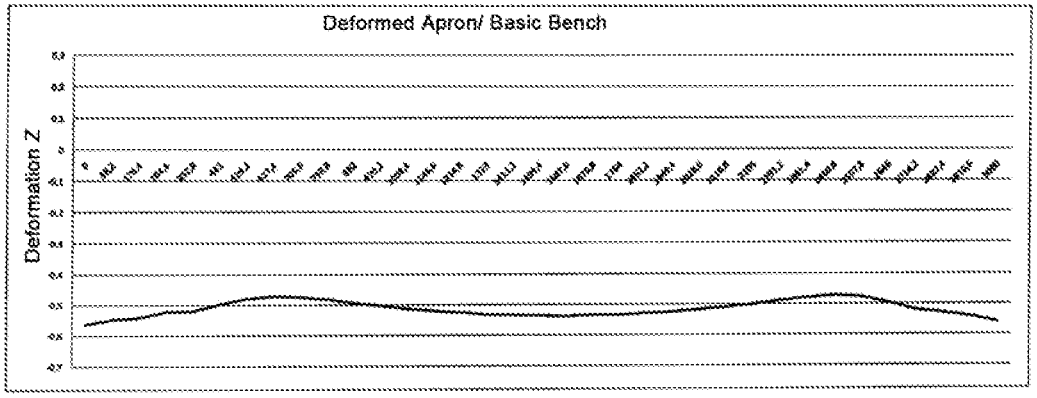
FIG. 9 shows a Cartesian graph in which the extension of the bench upper edge is reported in the ordinates, and the amplified deformation useful to determine the substantially rectilinear trend of the edge is reported in the abscissae.
Figure 10:
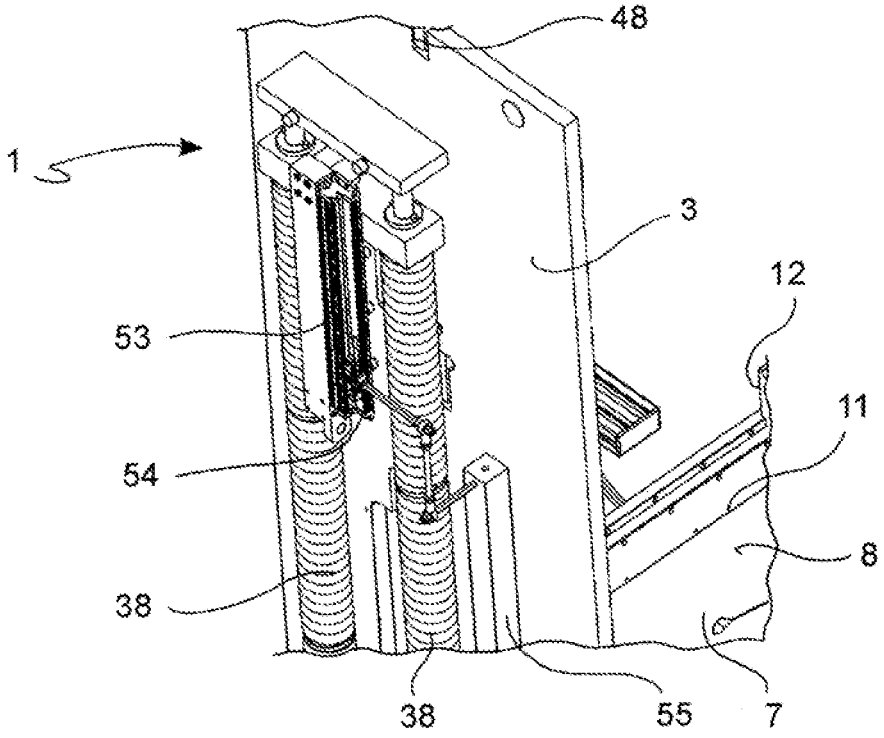
FIG. 10 shows in axonometric view a detail of the press brake of FIG. 1 in which the outer covers 56 have been removed to highlight the spring unit stressing the rammer moving away from the bench tool, to which rammer end connected to the springs an optical line is associated, the reader of which faces it and is supported by a structure that is independent from the shoulder and directly resting on the base so as not to be affected by the deformation of the machine structure.
Figure 11:
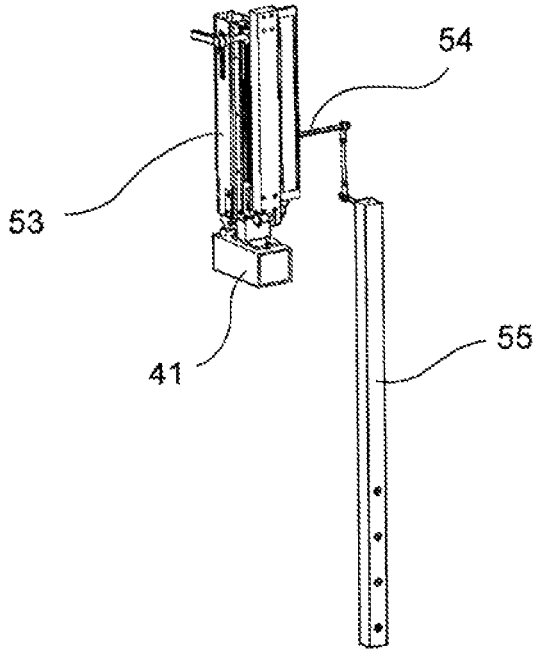
FIG. 11 illustrates in axonometric view a detail of the detection sensor of the rammer stroke or movement.
Figure 12:
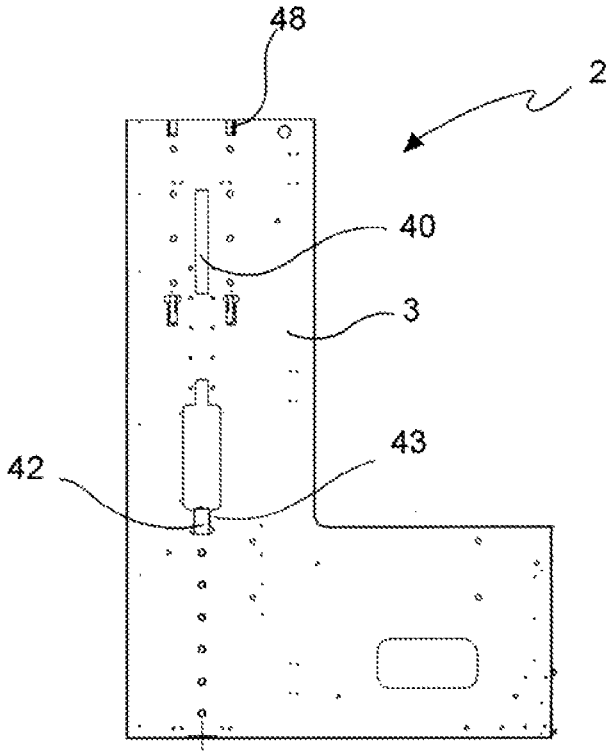
FIG. 12 illustrates a supporting structure of the press brake as seen from the right side.
Figure 13:
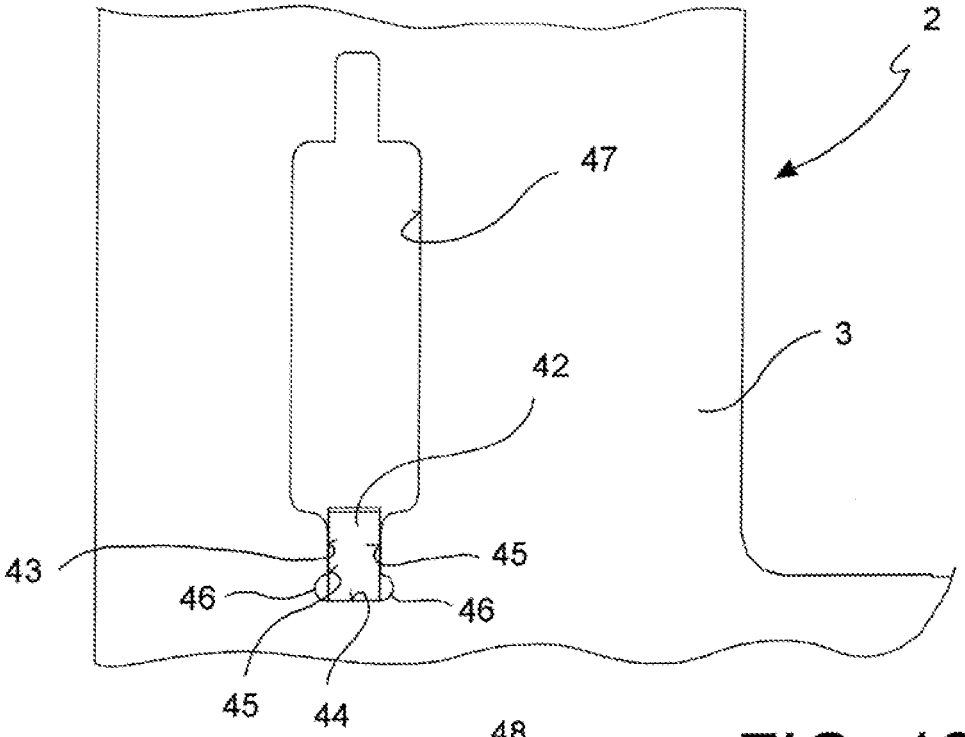
FIG. 13 shows in side view a detail of the right shoulder of the structure in which a window for support and inspection and maintenance of the bench and other internal parts of the machine is highlighted.
Figure 14:
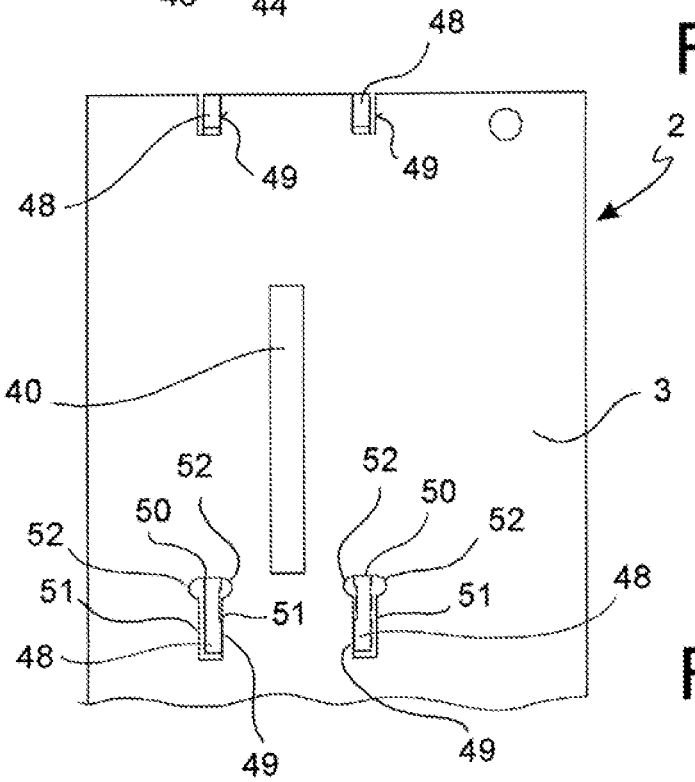
FIG. 14 shows in side view a detail of the right shoulder of the structure, in which windows for a temporary support of the upper crossbeams to properly secure them to the shoulder are highlighted, where upper support surfaces opposite to the action of the springs stressing the rammer away from the bench are highlighted.
Figure 15:
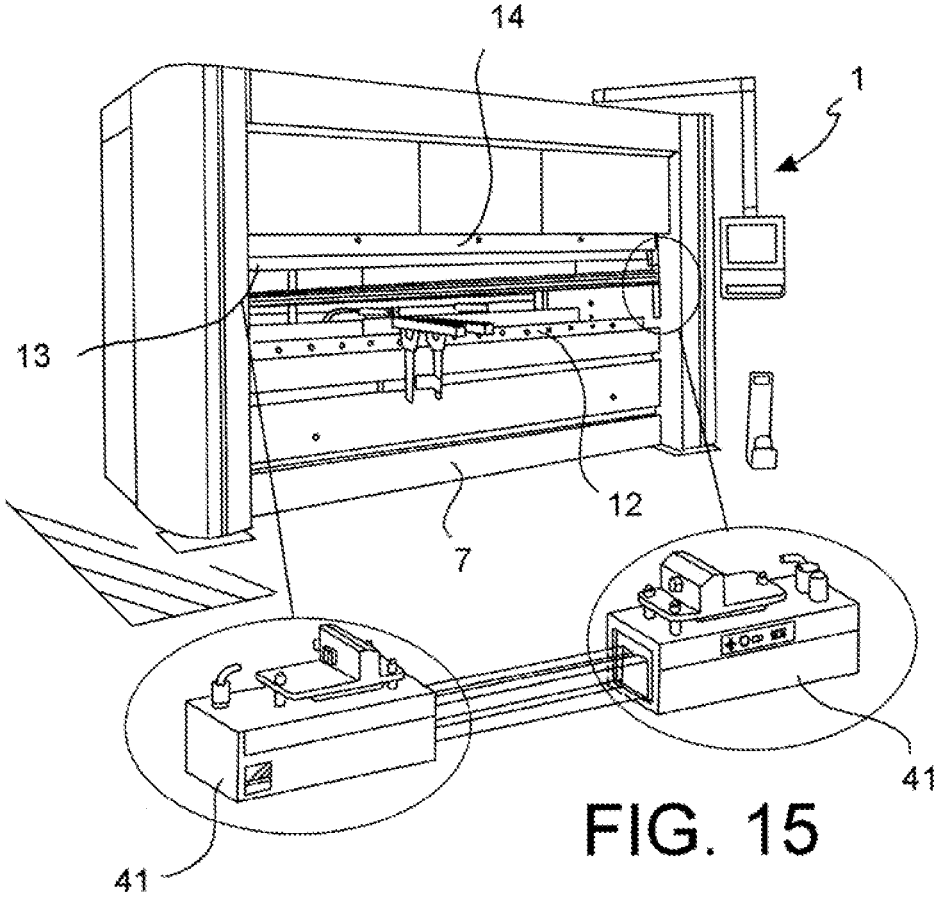
FIG. 15 shows in perspective view a press brake, in which safety barriers that are movable with the rammer are highlighted and shown separately.
Figure 16:
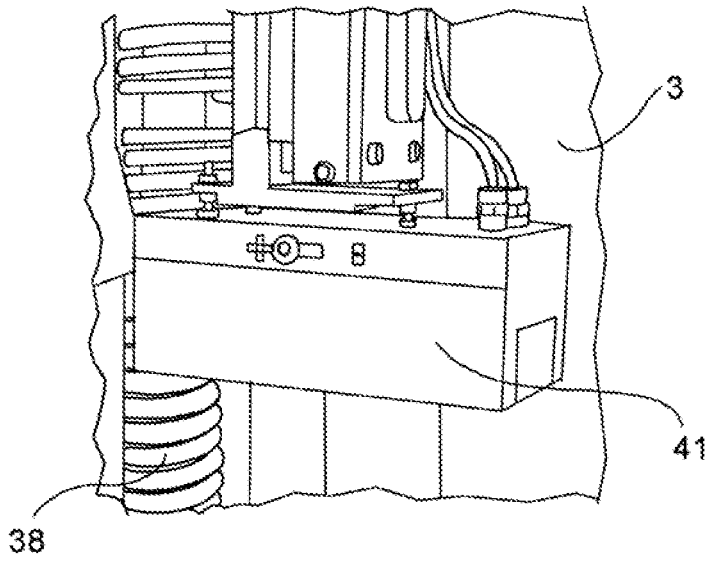
FIG. 16 shows in perspective view a detail of the safety laser barrier of FIG. 15.
Figure 17:
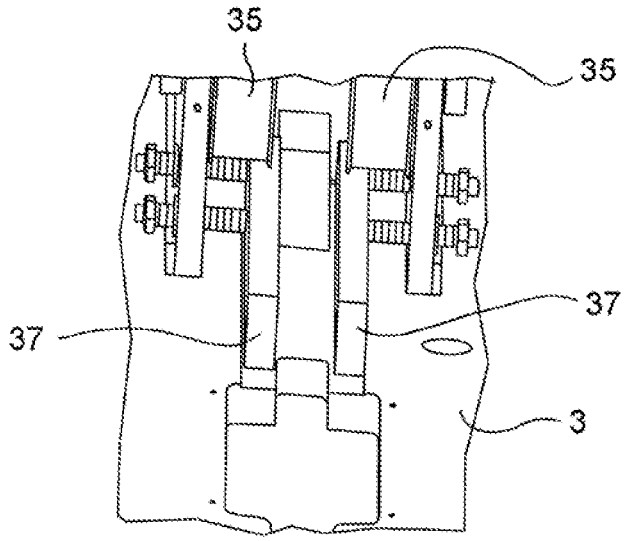
FIG. 17 illustrates in axonometric view a detail of the guides for the rammer.
Figure 18:
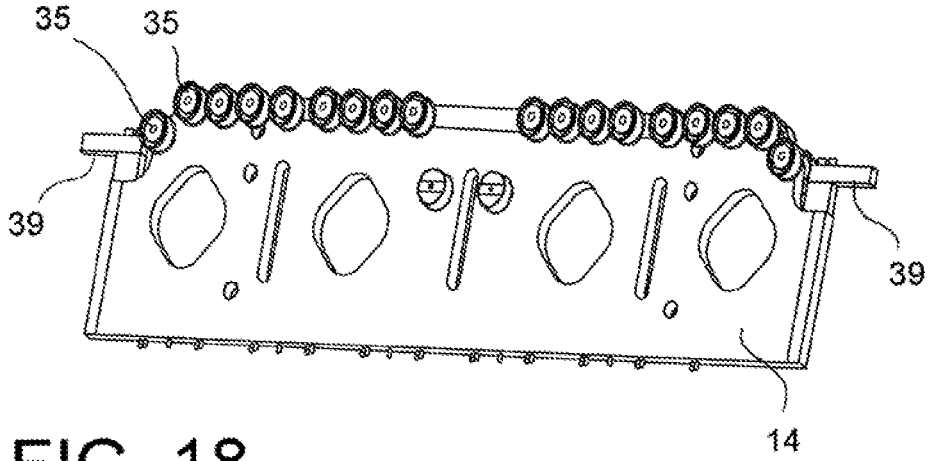
FIG. 18 illustrates in axonometric view a rammer.
Figure 19:
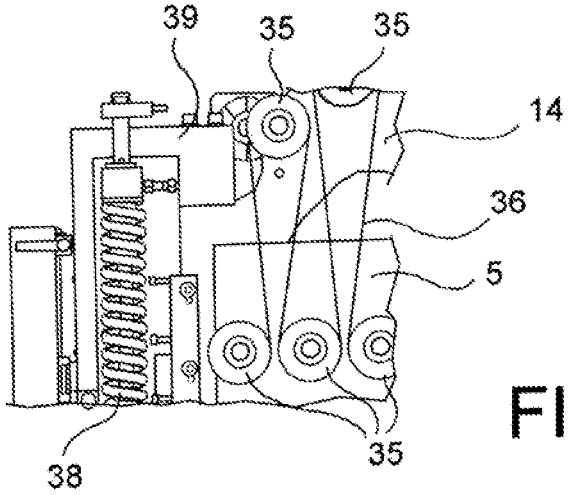
FIG. 19 shows in axonometric view a detail of the movement kinematics of the rammer operatively connected to the upper crossbeams and stressed by the springs.

As it can be seen from the annexed Figures, a press brake 1 comprises a supporting structure 2. Said supporting structure comprises a first flank or shoulder 3, for example, arranged at the right side of the machine when seen frontally, and a second flank or shoulder 4, for example, arranged at the side of the machine press brake on the left when seen frontally.

In accordance with an embodiment, said two flanks 3, 4 are connected together superiorly by at least one upper crossbeam 5.

Advantageously, in accordance with an embodiment, said two flanks 3 and 4 are connected together superiorly by two upper crossbeams 5, 6, which are arranged mutually facing and creating an interspace therebetween.

In accordance with an embodiment, said two crossbeams 5, 6 are secured with their heads to the facing surfaces of the two flanks 3, 4 and securely locked, for example, but not necessarily, by means of bolts received in threaded seats that are drilled in the body of the upper crossbeams 5, 6.

In accordance with an embodiment, in order to promote assembling, the at least one upper crossbeam 5 or 6 has a cantilevered extension or supporting shelf or crossbeam assembling shelf 48 extending by fitting in crossbeam assembling windows 49 provided for in the flanks 3 or 4.

In accordance with an embodiment, further crossbeam 5 or 6 shelves 48 protrude longitudinally, by fitting in further windows 49 provided for in the flanks 3 or 4. Said windows 49 have crossbeam support bases 50 arranged superiorly to the shelves 48 and suitable to receive and support the crossbeam shelf 48 when stressed during the handling operations of the machine vertically upwardly. In accordance with an embodiment, said windows 49 have crossbeam guide flanks 51 that are suitable to support the crossbeam 5 or 6 shelf 48.

In accordance with an embodiment, between said support bases 50 and said guide flanks 51, widenings or roundings 52 are provided for, which locally widen the size of the window 49 so as to reduce the localized concentration of the stresses due to the strong rest of the crossbeam on the supporting structure, and in particular on the flanks or shoulders 3 or 4.

In accordance with an embodiment, said two flanks 3, 4 are connected together inferiorly by a beam or apron or lower bench 7. Said lower bench 7 is secured to the two flanks 3, 4 in a non-movable manner.

In accordance with an embodiment, said lower bench 7 is secured to the shoulders 3, 4 by means of bolts, for example, tie rods, received in threaded seats provided for in the bench body 16.

In accordance with an embodiment, said lower bench 7 has laterally bench support shelves 42 to the shoulders 3 or 4 cantileverly protruding from the bench body 16. In accordance with an embodiment, said bench support shelves 42 fit in bench support windows 43 provided for in the shoulders 3, 4. In accordance with an embodiment, said bench support windows 43 have inferiorly a bench shelf support base 44 suitable to form a strong abutment and support surface of the bench to the supporting structure 2.

In accordance with an embodiment, said bench support windows 43 have laterally guide flanks 45 suitable to guide the bench support shelf 42.

In accordance with an embodiment, between said bench support base 44 and said guide flanks 45, widenings or roundings 46 are provided for, which locally increase transversally the dimensions of the support window 43 so as to reduce the localized concentration of the stresses caused by the strong rest of the bench on the structure of the shoulder 3 or 4.

In accordance with an embodiment, said lower bench 7 has a plate-shaped body 16 having a front surface 8, facing outwardly relative to the machine, a rear surface 9, for example, facing inwardly to the machine, where, for example, a securing and/or handling system for the working piece is housed. In accordance with an embodiment, said lower bench 7 has a plate-shaped body 16 having an edge 10.

Advantageously, and in accordance with a further embodiment, said edge 10 comprises an upper edge portion 11 suitable to be at least partially connected to a mould 12. In accordance with an embodiment, said upper edge 11 faces the movable part of the press brake to cooperate with a tool 13 and to deform, for example, to bend, a working piece interposed therebetween.

In accordance with an embodiment, said press brake 1 further comprises a movable rammer or beam 14 movably connected relative to the supporting structure 2, so as to allow a movement of the rammer 14 along a direction transversal to the longitudinal extension thereof, to approach said lower bench 7, particularly to cooperate with said upper edge 11 for the processing of a piece.

In accordance with an embodiment, said rammer 14 supports a tool 13 suitable to cooperate with the mould 12 during the approaching movement of the rammer 14 to the lower bench 7, to process a piece interposed therebetween.

Advantageously, and in accordance with an embodiment, said lower bench 7 has a first slot 15 cutting the bench body 16, forming a first window 17. In accordance with an embodiment, said first window 17 opens on the edge 10 of said bench 7, forming a first portion 18 of the bench body 16, which, when the bench 7 is stressed by the action of the rammer 14, deforms differently from a contiguous portion 19 of the bench body 16.

Advantageously, according to an embodiment, said first slot 15 forms a first window 17 opening on the upper edge 11 of the bench 7. In accordance with a first embodiment, said first slot 15 extends, by passing under the upper edge 11 through an extension thereof that is lateral to the bench 7, for example, but not necessarily, according to a direction inclined relative to the upper edge 11 so as to progressively approach said upper edge 11 by passing from the bench centre to the lateral periphery of the bench 7, to then bend again and open on the upper edge 11 in a preferably side area of the bench so as to leave an integral portion of the upper edge associable to the mould 12.

With particular advantage, in accordance with an embodiment, said lower bench 7 has a second slot 20 cutting the bench body 16, forming a second window 21. In accordance with an embodiment, said second window 21 has a window edge 22, which is closed. In accordance with an embodiment, said window edge 22 has a closed annular path. In accordance with an embodiment, said second window 21 is made so as to avoid that it opens on the edge 10 of the bench 7.

With particular advantage, in accordance with an embodiment, said second window 21 extends substantially along a direction inclined relative to the upper edge 11 of the bench.

In accordance with an embodiment, said second window 21 extends by passing through the centreline or centre of the bench, for example the centreline indicated by the vertical line in the figures with references X-X, passing at a side of the bench 7, progressively approaching the upper edge 11. In accordance with a particularly advantageous embodiment, said second window 21 partially overlaps said first window 17, by overlapping being meant a flanking of the two windows 21, 17 so that a line transversal to the upper edge 11 passes through both windows 21, 17. In accordance with an embodiment, said overlapping of the two windows 21, 17 occurs only over an end or side length of the second window 21 and an initial or central length of the first window 17.

In accordance with an embodiment, said overlapping between the two windows 21, 17 occurs so that said second window 21 is comprised between said first window 17 and the upper edge 11 of the bench 7.

In accordance with an embodiment, the overlapping between said two windows 21 and 17 occurs only over the widened terminal parts 32 and 27 thereof.

Advantageously, in accordance with an embodiment, said second window 21 forms a third portion 23 of the bench body 16 which, when the bench 7 is stressed by the action of the rammer 14, deforms differently from the contiguous portions 18 and 19 of the bench body 16 and so as to ensure a substantial planarity of the upper edge 11 of the bench 7 also when it is subjected to the action of the tool 13 on the piece to be deformed, and therefore on the mould 12.

In accordance with an embodiment, said press brake 1 comprises a first slot 15 cutting the bench body 16, forming a first window 17. In accordance with an embodiment, said first window 17 opens on the upper edge 11 of the bench 7 forming a first portion 17 of the bench body 16, which, when the bench 7 is stressed by the action of the rammer 14, deforms differently from a contiguous portion 19 of the bench body 16.

In accordance with a first embodiment, said first and second slot 17, 21 are arranged in the bench body 16 so as to ensure a substantial planarity of the upper edge 11 of the bench 7 when this is stressed by the rammer 14.

In accordance with an embodiment, said bench 7 is a symmetrical structure compared to a structure that is transversal to the upper edge 11, for example, but not necessarily, relative to the centreline X-X of the bench 7. Each of the first and second slots 15, 21 are two slots arranged in a mutually symmetrical manner relative to the transversal line or centreline X-X of the bench 7.

In accordance with an embodiment, said first slot 17 is of an elongated shape, and extends initially with a first length 24 of the first slot in a slightly inclined manner relative to the upper edge 11, for example, but not necessarily, approaching the upper edge 11 passing from the centreline towards the side of the bench 7. In accordance with an embodiment, continuing on, said first slot forms a first slot second length 25 that is more inclined relative to the first length 24, for example, but not necessarily, approaching more rapidly to the upper edge 11 of the bench 7 passing from the centreline towards the bench side. In accordance with an embodiment, said first slot 17 ends with a first slot third length 26 substantially transversal to the upper edge 11, which, in accordance with an embodiment, opens on said upper edge 11, thus opening laterally said window.

In accordance with an embodiment, said first slot 17 has a first end thereof closed, for example, but not necessarily, going towards the centreline X-X of the bench 7. In accordance with an embodiment, said first window 17, where it ends in the bench body 16, has an enlargement 27, for example, but not necessarily, a through hole substantially circumferential, which enlargement 27 is suitable to reduce the localized concentration of the stresses.

In accordance with an embodiment, said second slot 21 extends substantially in a rectilinear manner, while remaining substantially slightly inclined relative to the upper edge 11, for example, but not necessarily, approaching the upper edge 11 passing from the centreline X-X to the bench 7 side.

In accordance with an embodiment, a portion 28 of said second slot 21 is located between the upper edge 11 and said first slot 17.

In accordance with an embodiment, said second slot 21 ends at both its ends 29, 30 with enlargements 31, 32, for example, but not necessarily, substantially circumferential through holes, which enlargements 31, 32 are suitable to reduce the localized concentration of the stresses.

In accordance with an embodiment, two second slots 21, 33 substantially symmetric relative to an axis transversal to the upper edge 11 are provided for, for example, but not necessarily, the centreline X-X of the bench 7. In accordance with an embodiment, said two second slots 21, 33 move away from the centreline X-X substantially according to two directions that are slightly inclined relative to the upper edge 11, in the form of two arms not jointed together of a "V".

In accordance with an embodiment, two first slots 17, 34 are provided for in a mutually symmetrical manner relative to an axis transversal to the upper edge 11, for example, but not necessarily, the centreline X-X of the bench 7. In accordance with an embodiment, said two first slots 17, 34 move away from the transversal axis or the centreline X-X substantially according to two directions that are slightly inclined relative to the upper edge 11, to subsequently bend substantially parallel to the transversal line or centreline X-X in the form of two arms not jointed together of a "U".

In accordance with an embodiment, said two flanks 3, 4 of the supporting structure 2 of the press brake machine are connected together superiorly by a first upper crossbeam 5 and by a second upper crossbeam 6. In accordance with an embodiment, said crossbeams 5 and 6 are located facing one another, supporting therebetween the rammer 14 in a movable manner.

In accordance with an embodiment, said edge 10 of the bench body 16 comprises an upper edge portion 11 suitable to be at least partially connected to a mould 12 suitable to cooperate with a tool 13 supported by said rammer 14. In accordance with an embodiment, said bench 7 is provided with support shelves 42 of the bench to the shoulders 3, 4, fitted in bench support windows 43.

In accordance with an embodiment, said windows 43 are provided with support bases 44 and guide flanks 45 jointed together by enlarged and rounded portions 46 for the reduction of the concentration of the stresses.

In accordance with an embodiment, said bench support windows 43 continue on the side opposite the support base 44 with an inspection and maintenance widening 47, which, for example, without limitation, allows accessing the upper bore or the mould or tool, or to safety sensors associated to the tool.

In accordance with an embodiment, said rammer 14 is guided between said shoulders 3, 4 by sliding into adjustable guides 37, each of which being adjustable on at least two points in order to guide said rammer 14 in its approaching movement towards the upper edge 11 of the bench 7.

In accordance with an embodiment, said first and second upper crossbeams 5, 6 and said rammer 14 have guide devices or pulleys 35 alternated on the crossbeams 5, 6 and on the rammer 14, on which at least one strap 36 is wound, preferably, but not necessarily, two straps, which, subjected to a traction action, for example, by driving pulleys or pulleys connected to controlled gearmotors, bring the rammer 14 closer to the upper edge 11 of the bench 7. By virtue of the provision of an actuation of the movement of the obtained rammer by a plurality of pulleys on the rammer and on the crossbeams brought closer together by virtue of straps, it is possible to obtain an evenly spread rammer action on the entire longitudinal extension thereof, thus allowing very accurate and rapid press brake operations.

In accordance with an embodiment, said rammer 14 is forced away from the bench 7 by means of springs 38.

In accordance with an embodiment, said springs 38 are located externally associated to the shoulders 3, 4 by connecting to cantilevered extensions or noses 39 of the rammer 14 exiting the windows 40 provided for in the shoulders 3, 4.

In accordance with an embodiment, to said rammer 14 a laser sensor 41 is associated, forming an optical barrier that moves together with the rammer 14, capable of detecting obstacles to the movement of the rammer and of locking the machine. By virtue of this sensor, it is possible to maintain an easy and rapid load and movement accessibility of the piece during the processing, without thereby losing in any way the maximum safety in the operation of the machine.

In accordance with an embodiment, said laser sensor 41 is arranged slightly ahead of the position of the tool 13 in the path of the tool 13 associated to said rammer 14.

In accordance with an embodiment, said upper crossbeam 5, 6 is provided with assembling shelves 48 of the crossbeam to the shoulders 3, 4, fitted in crossbeam assembling windows 49.

In accordance with an embodiment, said windows 49 are provided with support bases 50 for the assembling shelves 48 and guide flanks 51 for the assembling shelves 48 jointed together by enlarged and rounded portions 52 for the reduction of the concentration of the stresses.

In accordance with an embodiment, said supporting structure 2 is made with shoulders 3, 4, each being made with a single piece for each side forming the supporting columnar structure of the crossbeams 5, 6 and the bench 7.

In accordance with an embodiment, a sensor 53 for the detection of the shifting or stroke of the rammer 14 is connected to the rammer, which is directly supported to the press brake base, thus avoiding to be connected to the supporting structure 2, so as not to be affected by the structure 2 deformation during the actuation of the press brake. By virtue of this solution, the rammer movements are measured and backfeed the actuation of the rammer in a much more controlled way, thus allowing more rapid and much more accurate processing operations, while remaining in the principle of not eliminating the structure deformations, but rather of controlling them, so as to obtain accurate processing operations.

In accordance with an embodiment, to the rammer 14 an optical line 53 is connected, which a sensor or reader 54 faces, which is not in contact with the optical line, but which is supported by a structure independent from the shoulder 55 directly resting on a base so as not to be affected by the deformation of the press brake structure 2.

It shall be apparent that those of ordinary skill in the art, with the aim of meeting contingent, specific, needs, will be able to make a number of modifications and variations, which still fall within the intended scope of the present invention described and claimed herein.

| REFERENCES | |
|---|---|
| 1 | Press brake |
| 2 | supporting structure |
| 3 | shoulder |
| 4 | shoulder |
| 5 | first upper crossbeam |
| 6 | second upper crossbeam |
| 7 | bench |
| 8 | front surface |
| 9 | rear surface |
| 10 | edge |
| 11 | upper edge |
| 12 | mould |
| 13 | tool |
| 14 | rammer |
| 15 | first open slot |
| 16 | bench plate-shaped body |
| 17 | first window opened on the edge |
| 18 | first bench body portion |
| 19 | contiguous bench body |
| 20 | second slot |
| 21 | second window closed on the edge |
| 22 | window edge |
| 23 | third portion of the bench body |
| 24 | first length of the first slot |
| 25 | second length of the first slot |
| 26 | third length of the first slot |
| 27 | slot end enlargement |
| 28 | second slot portion |
| 29 | second slot end |
| 30 | second slot end |
| 31 | second slot end enlargement |
| 32 | second slot end enlargement |
| "X-X" | bench centreline |
| "V" | closed slots shape |
| "U" | open slots shape |
| 33 | symmetrical to second closed slot |
| 34 | symmetrical to first closed slot |
| 35 | pulleys |
| 36 | strap |
| 37 | adjustable rammer guides |
| 38 | rammer lifting springs |

-continued

| REFERENCES | |
|---|---|
| 39 | rammer noses |
| 40 | windows for noses in shoulders |
| 41 | laser sensor of safety barrier |
| 42 | bench support shelf to the shoulders |
| 43 | bench support window in shoulder |
| 44 | bench shelf support base |
| 45 | guide flanks |
| 46 | widenings of reduction concentration stresses |
| 47 | inspection and maintenance widening |
| 48 | crossbeam assembling shelf |
| 49 | crossbeam assembling windows |
| 50 | crossbeam support bases |
| 51 | crossbeam guide flanks |
| 52 | crossbeam window widenings |
| 53 | stroke rammer detection optical line |
| 54 | detection sensor |
| 55 | independent sensor supporting structure |
| 56 | covers for the protection of the machine structure and components |

The invention claimed is:

1. A press brake having a supporting structure comprising:

a flank located on each side of the press brake, each flank having a top portion and a bottom portion;

the top portion of each flank being connected by at least one upper crossbeam, and the bottom portion of each flank being connected by a lower bench and secured in a non-movable manner relative to said flanks;

said lower bench having a plate-shaped body having a front surface, a rear surface opposite the front surface, and an edge, said edge comprising an upper edge portion suitable for being at least partially connected to a mould, said press brake further comprising a rammer movably connected relative to said supporting structure along a direction transverse to a longitudinal extension thereof to approach said lower bench, said rammer supporting a tool suitable for cooperating with said mould to process a piece interposed therebetween;

wherein said lower bench includes a first slot in a bench body forming a first window, said first window opening on the edge of said bench forming a first portion of the bench body;

wherein said lower bench has includes a second slot in the bench body forming a second window, said second window having a window edge which is closed so as to avoid having the second window opening on the edge of said bench; said second window extending substantially along a direction inclined relative to said upper edge of the bench and partially overlapping said first window in a direction transverse to said upper edge of the bench; said second window forming a third portion of the bench body; and wherein said first and second slot provide variable flexibility along the lower bench so as to ensure a substantial planarity of the upper edge of the bench.

2. The press brake of claim 1, wherein said bench is a symmetrical structure relative to a transversal upper edge and each of the first and second slots are arranged in a mutually symmetrical manner relative to a transverse or centerline of the bench, and wherein said first slot is of an elongated shape, extending initially with a first slot first length slightly inclined relative to upper edge, continuing with a first slot second length more inclined relative to the first length and ends with a first slot third length substantially transversal to the upper edge.

3. The press brake of claim 1, wherein said second slot extends substantially in a rectilinear manner, while remaining substantially slightly inclined relative to the upper edge;

and wherein a portion of said second slot is arranged between the upper edge and said first slot.

4. The press brake of claim 1, wherein said top portions of each flank are connected by a first upper crossbeam and a second upper crossbeam;

and wherein said crossbeams are located facing one another supporting therebetween the rammer in a movable manner.

5. The press brake of claim 1, wherein said mould is suitable for cooperating with a tool supported by said rammer;

wherein said bench is provided with support shelves of the bench to the flanks fitted in bench support windows, said windows being provided with support bases and guide flanks joined together by enlarged and rounded portions for a reduction of stresses;

and wherein said bench support windows continue on a side opposite the support base with an inspection and maintenance widening.

6. The press brake of claim 4, wherein said first and second upper crossbeams and said rammer have guide devices alternating on the crossbeams and on the rammer on which at least a strap is wound, which, when it is subjected to a traction action, moves the rammer closer to the upper edge of the bench.

7. The press brake of claim 1, wherein said rammer is forced away from the bench by springs;

and wherein said springs are located externally and associated with the flanks by connecting to cantilevered extensions or noses of the rammer exiting windows provided for in the flanks.

8. The press brake of claim 1, wherein a laser sensor is associated with said rammer, said laser sensor forming an optical barrier which moves together with the rammer, and which is capable of detecting obstacles to the movement of the rammer and of locking the machine;

and wherein said laser sensor is arranged ahead of to the tool position in the tool path associated with said rammer.

9. The press brake of claim 1, wherein said upper crossbeam comprises assembly shelves of the crossbeam with the flanks fitted in crossbeam assembling windows, and wherein said windows are provided with support bases for the assembly shelves and guide flanks for the assembly shelves joined together by enlarged and rounded portions for the reduction of the concentration of the stresses.

10. The press brake of claim 1, wherein said flanks comprise one piece on each side, forming the supporting columnar structure of the crossbeams and the bench.

11. The press brake of claim 1, wherein a sensor for the detection of the shifting or stroke of the rammer is connected to the rammer, which is directly supported on the press brake base and wherein an optical line is connected to the rammer, which a sensor or reader faces, which is supported by a structure independent from the flanks that directly rest on a base so as not to be affected by the press brake structure deformation.

12. The press brake of claim 1, comprising a further second slot, said further second slot and second slot being substantially symmetrical relative to a centerline of the bench, said second slots together forming a "V" shape with respect to the centerline of the bench; and a further first slot, said further first slot and first slot being substantially symmetrical relative to the centreline of the bench, said first slots together forming a "U" shape with respect to the centerline of the bench.

* * * * *